US005230120A

United States Patent [19]

Ireson et al.

[11] Patent Number: 5,230,120

[45] Date of Patent: Jul. 27, 1993

[54] ONE-PIECE PAD HOLDER FOR A FLOOR BUFFING MACHINE

[75] Inventors: Jack Ireson, Galax, Va.; Charles W. Joines, Sparta, N.C.; W. Darrell Ward, Independence; William F. Halsey, Galax, both of Va.

[73] Assignee: Pioneer/Eclipse Corporation, Sparta, N.C.

[21] Appl. No.: 820,003

[22] Filed: Jan. 13, 1992

[51] Int. Cl.[5] ..... A47L 11/14

[52] U.S. Cl. ..... 15/230.17; 15/98; 15/230; 51/358

[58] Field of Search ..... 15/98, 230, 230.14, 15/230.15-230.19; 51/177, 358; 300/21

[56] References Cited

U.S. PATENT DOCUMENTS

| | | | |
|---|---|---|---|
| 1,809,907 | 6/1931 | Newcomb | 15/230 |
| 3,684,325 | 8/1972 | Okun | 15/230.17 |
| 3,742,550 | 7/1973 | Wakefield | 15/230 |
| 3,823,516 | 7/1974 | Christian | 15/230.17 |
| 4,307,480 | 12/1981 | Fallen | 15/230.18 |
| 4,701,970 | 10/1987 | Wilson | 15/98 |
| 4,709,439 | 12/1987 | Warren et al. | 15/230.16 |
| 4,830,807 | 5/1989 | Warren et al. | 264/235 |

*Primary Examiner*—Edward L. Roberts

*Attorney, Agent, or Firm*—Wigman, Cohen, Leitner & Myers

[57] ABSTRACT

A one-piece dual durometer pad holder for use in a floor buffing machine has an outer radial portion and an inner radial portion. The outer radial portion is made from a first hardenable material having a first durometer hardness in its hardened state, and the inner radial portion is made from a second material having a second durometer hardness in its hardened state, with the second durometer hardness being less than the first durometer hardness. The outer and inner radial portions are interconnected in such fashion as to prevent shear failure between the two portions. The method of making the floor pad holder includes spin casting the outer radial portion from the first harden- able material, and then, while the first hardenable material is in its unhardened state, spin casting the second hardenable material in a single spinning operation. The materials are allowed to cure at the same time, forming a smooth and continuous bond between the two durometer portions of the pad holder. The pad holder thus formed is resistant to breakage when striking a hard or sharp object as well as to shear failure at the interface between the two materials forming the pad holder.

13 Claims, 2 Drawing Sheets

ONE-PIECE PAD HOLDER FOR A FLOOR BUFFING MACHINE

FIELD OF THE INVENTION

The present invention relates to floor buffing machines, and more particularly to a pad holder for use in such floor buffing machines, as well as to a method for making the pad holder.

DESCRIPTION OF THE PRIOR ART

A search of the prior art failed to uncover any prior art reference which discloses the method of making the pad holder, or the pad holder, of the present invention. The following patents were uncovered which disclose either a method of making a pad holder for such buffing machines, or a pad holder: U.S. Pat. Nos. 3,823,516 to Christian; 4,307,480 to Fallen; 4,701,970 to Wilson; and 4,709,439 and 4,830,807, both to Warren et al.

The patent to Fallen discloses a disc drive pad support structure which is made from a lightweight sheet metal such as aluminum. Since the pad support is thin in the central area of the pad support, i.e., in the area in which the drive shaft supplies the torque to rotate the pad support, a separate drive plate is mounted by bolts to this central area.

The patent to Wilson, commonly assigned to the assignee of the present invention, and incorporated herein by reference, discloses a high speed floor buffing machine having a pad holder which is formed from a hub to which are attached four radially extending outer arm portions, either by molding or bolts, to support an X-shaped buffing pad.

The patent to Christian is directed primarily to a floor polishing machine pad holder which is supplied with Velcro-type hook pads for the retention of the pad.

The patents to Warren et al. are directed to a mounting disc for a floor polisher and to the method of making the mounting disc. The mounting disc is provided with a plastic hub portion and a plastic rim portion encircling the hub portion. The hub and rib are injection molded from a relatively rigid plastic material and are interconnected by a relatively soft plastic in a separate molding step which takes place after annealing of the rim and hub.

While the prior art pad holders are generally suited for their intended purpose, there are several problems and drawbacks inherent in their design and practical application. Due to their construction, design, and use of materials there is a tendency on the part of the rigidly formed rim portion of the pad holder to break when striking a hard or sharp object. Further, while the relatively soft plastic interconnecting the hub and rim is designed to provide flexibility to the pad holder, it creates a situation in which the pad holder is subject to shear failure at the soft/hard plastic interfaces. Finally, due to the number of steps which are required to make the prior art pad holder as well as to the discontinuous nature of the process, making the pad holders according to the prior art method is relatively costly, time consuming, and inefficient.

SUMMARY OF THE INVENTION

In view of the foregoing limitations and shortcomings of the prior art devices, as well as other disadvantages not specifically mentioned above, it should be apparent that there exists a need in the art for a pad holder for a floor buffing machine which is sturdy and resistant to breakage when striking hard or sharp objects during normal use. It is also apparent that there is a need in the art for a method of making a floor buffing machine pad holder which is less costly and more efficient to practice.

It is, therefore, a primary object of this invention to fulfill that need by providing a floor buffing machine pad holder which eliminates multiple part pad holder designs and instead provides a unitary construction for the pad holder which is less subject to breakage and shear failure.

Another object of the invention is to provide a floor buffing machine pad holder which is relatively simple in design and is thus readily manufactured.

It is another object of the invention to provide a buffing machine pad holder of unitary construction which has a central portion made from a relatively flexible material, and an outer portion made from a relatively stiff material compared to the central portion, thereby increasing the flexibility and breakage-resistance characteristics of the pad holder.

It is yet another object of the present invention to provide a buffing machine pad holder having the aforementioned flexible central portion made from a relatively low durometer plastic material and a stiff outer portion made from a higher durometer plastic material in which the two portions are intimately interconnected and joined so as to greatly reduce the possibility of shear failure between the two portions.

Yet another object of this invention is to provide a method of making a floor buffing machine pad holder which is simpler and less costly than prior art methods.

Still another object of this invention is to provide a method of making a buffing machine pad holder in which the pad holder is molded in a single continuous process, thereby increasing the efficiency of making the pad holder.

It is still a further object of the present invention to provide a method of making a buffing machine pad holder in which a pad holder having a dual durometer plastic construction is produced in such a fashion that the two durometer components are intimately interconnected and joined.

Briefly described, the aforementioned objects are accomplished according to the invention by providing a one-piece, dual durometer flexible pad holder for use in floor buffing machines. The pad holder comprises an outer radial portion made from a first hardenable material having a first durometer hardness in its hardened state and an inner radial portion made from a second hardenable material having a second durometer harness in its hardened state, with the second durometer hardness of the inner portion being less than the first durometer hardness of the outer portion. The two durometer hardness portions of the inventive pad holder are joined and interconnected in a smooth and continuous fashion which reduces the possibility of shear failure between the two portions. Two fiberglass mats, a lower mat provided without a center hole, and an upper mat which is provided with a center hole, serve as reinforcements for the hardenable materials to produce the pad holder. A steel hub is cast into the center of the pad holder to provide a means for attaching the pad holder to the floor buffing machine drive shaft as well as for receiving a bolt which retains a pad-lock flange to hold a pad to the lower side of the pad holder. For further retention of the pad on the lower side of the pad holder, a plurality of holes are provided throughout the pad holder for the receipt of plastic Velcro® studs.

In its method aspects, the invention includes spin casting the two durometer hardness portions of the pad holder in a single spinning operation such that all the mold materials cure at the same time, reducing problems of adherence and strength at a bond between two different materials. According to the method, a spin casting mold is prepared and a fiberglass mat is placed in the bottom half of the mold, the fiberglass mat being formed without a center hole. A second fiberglass mat, formed with a center hole is placed on top of the first fiberglass mat. The top half of the mold is then installed on the bottom half of the mold and the molding compound, preferably a two component hybrid system containing unsaturated polyester/urethane, is prepared. The mold is then started spinning and is brought up to a speed of approximately 1200 rpm. The first blend of molding material is introduced into the spinning mold through a central port and the mold is continuously spun until the first mold material has penetrated to the outer periphery of the mold. While continuing to spin the mold at approximately 1000 to 1200 rpm, the second molding blend is introduced into the mold. When the mold has received the complete charge of molding material, the spin rate of the mold is reduced to approximately 200 rpm and held for a short period of time. Before the molding material is allowed to gel, the spinning process is stopped, and the molding material is allowed to gel in the stationary mold. In about 20 to 30 minutes the mold is opened and the molded part is removed.

With the foregoing and other objects, advantages and features of the invention that will become hereinafter apparent, the nature of the invention may be more clearly understood by reference to the following detailed description of the invention, the appended claims and to the several views illustrated in the attached drawings.

DETAILED DESCRIPTION OF THE PREFERRED EMBODIMENT

Figure 1:
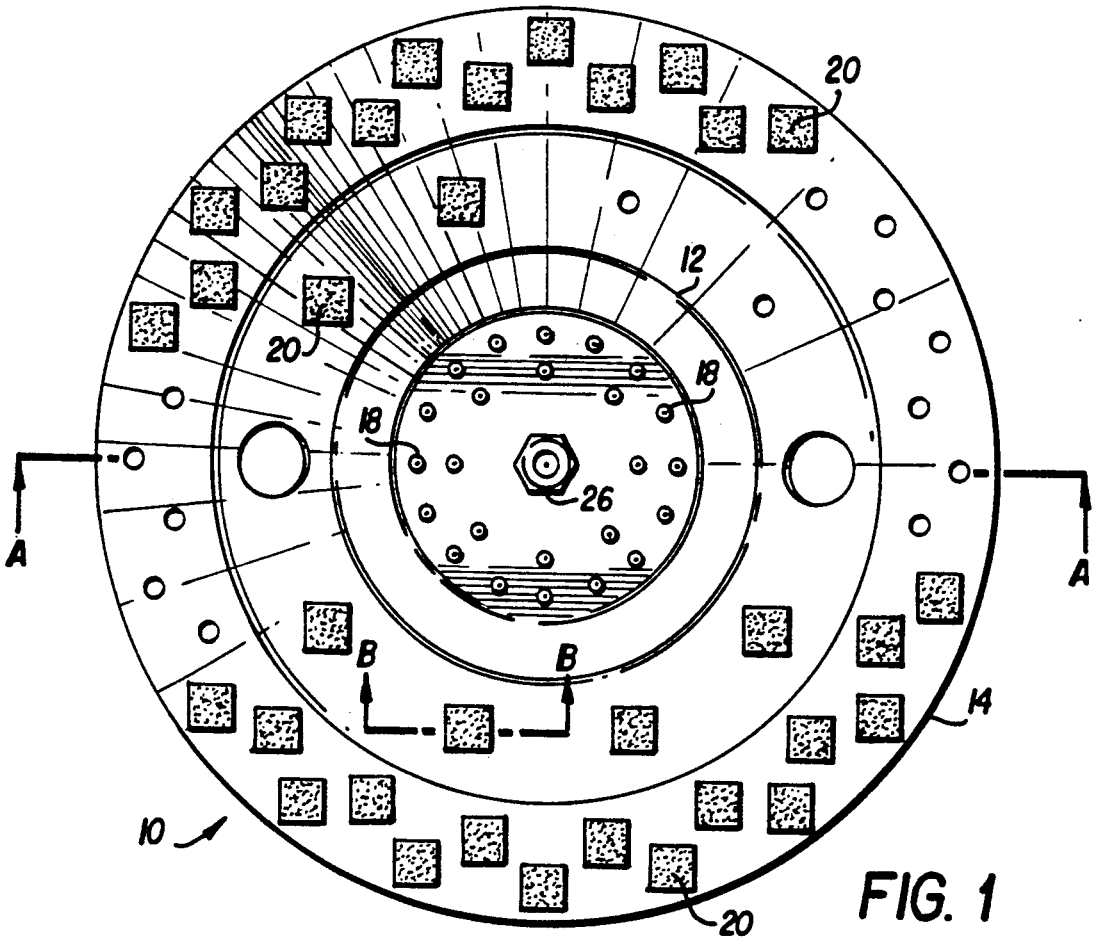
FIG. 1 is a bottom view of a floor buffing machine pad holder in accordance with the invention.
Figure 2:
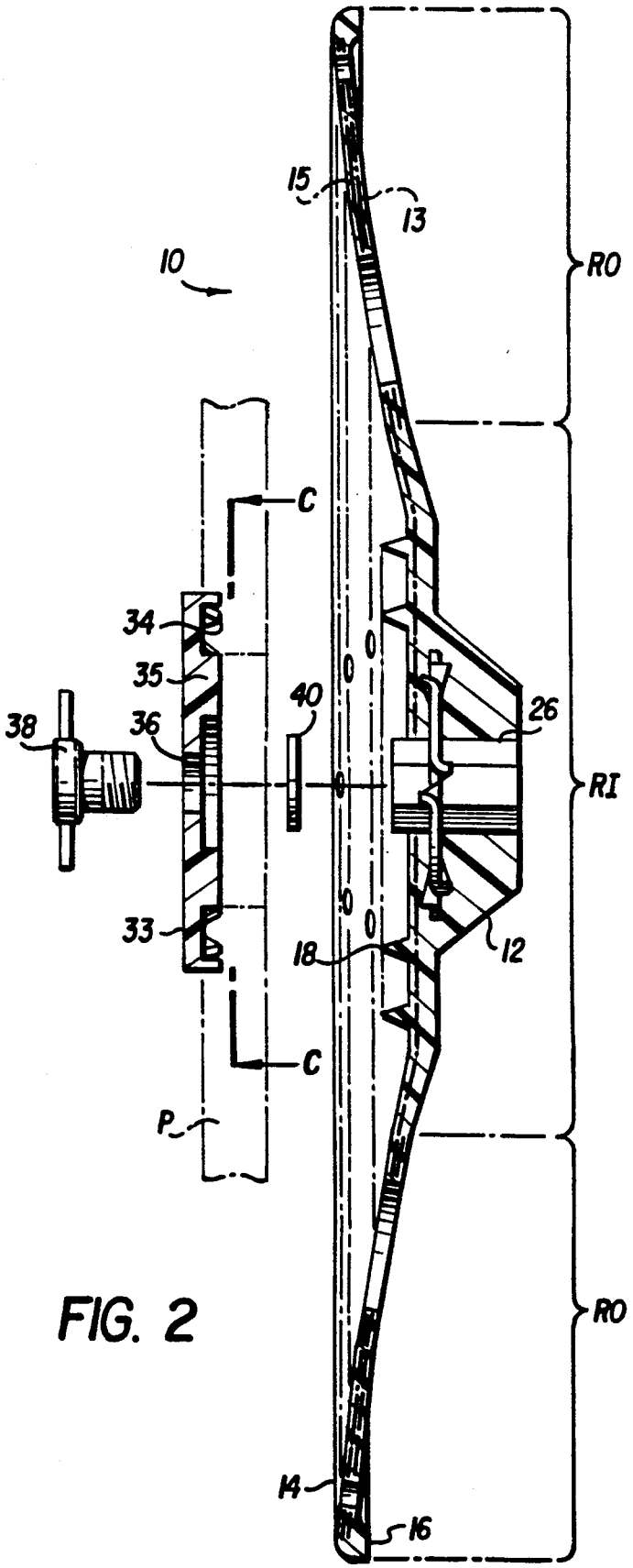
FIG. 2 is an exploded cross-sectional view, taken along line A—A of FIG. 1, showing the pad holder of the invention, together with the associated pad-lock flange and its retaining bolt.

Referring now in detail to the drawings, there is shown in FIGS. 1 and 2 a pad holder for use in floor buffing machines in accordance with the invention, the pad holder being designated generally by the reference numeral 10. As can be seen from FIGS. 1 and 2, pad holder 10 generally has the shape of a large, flat circular disc, and is made from a generally hard, durable resinous material, the details of which are set forth hereinafter. Pad holder 10 has a central hub portion 12 having an enlarged cross-section (FIG. 2) for increased strength in attaching the pad holder 10 to the drive shaft of a floor buffing machine. Extending radially outwardly from the central hub portion 12 is skirt 14 which provides a continuous, smooth support for a floor buffing pad attached to pad holder 10. Skirt 14 extends in a continuous circular arrangement, terminating in an upturned peripheral flange 16 which provides edge strength for pad holder 10.

Of particular importance is the structure and use of materials in forming pad holder 10. While pad holder 10 is molded into a unitary, one-piece construction, two component materials, each having a different specified durometer hardness, are used to form the pad holder. Referring specifically to FIG. 2, it will be seen that pad holder 10 is defined by two separate regions, a radially inner portion RI, forming hub portion 12 and its surrounding annular area, and a radially outer portion RO, generally forming the outer annular portion of skirt 14. Both radially outer portion RO and radially inner portion RI are comprised of a two component hybrid unsaturated polyester/urethane polymer system and differ from one another in the percentage blend of constituent components to produce a dual durometer hardness in the two regions of the pad holder 10.

Specifically, the material specification according to a preferred embodiment of the invention of the pad holder 10 is a derivative of Cook Composites & Polymers "Interpol system" unsaturated polyester/urethane two component hybrid system #47-5118/47-5205. The individual resin formulation for the two durometer portions is:

- 100 parts by weight of a blend of an unsaturated polyester and saturated polyester polyol
- 27 parts by weight of a polymethylene polphenyl isocyanate
- 2 parts by weight of benzoyl peroxide in tricresyl phosphate.

For the radially outer portion RO, the resin formulation is. a 60/40 blend of the unsaturated polyester and saturated polyester to produce a relatively higher durometer hardness and stiff or semi-rigid skirt 14 for pad holder 10. For the radially inner portion RI, the resin formulation is a 50/50 blend of the unsaturated polyester and saturated polyester to produce a relatively lower durometer hardness and a more flexible annular portion surrounding portion RI and hub 12 of pad holder 10. The resultant dual durometer pad holder has a relatively strong, semi-rigid radially outer portion RO, and a relatively flexible radially inner portion. RI, which helps to prevent breakage when the pad holder strikes a hard or sharp object.

Further, two fiberglass mats, 13, 15 in the form of large circular flat mats, are provided as a support and matrix for the plastic material forming pad holder 10. In the preferred embodiment, each mat 13, 15 is 1 ply of 1.5 ounce N-751 Nicofiberglass having a diameter of 21 inches. One of the mats 13, is provided with a 12-inch hole in the center, and the other mat 15 has no hole. The 12-inch diameter hole in the one mat corresponds generally to the diameter of the RI portion of the pad holder so that two fiberglass layers are present in the RO portion and only one layer is present in the RI portion. Further details of the placement of the fiberglass mats and their relationship with the resin formulation are explained hereinafter in connection with the description of the method of making the pad holder.

Figure 4:
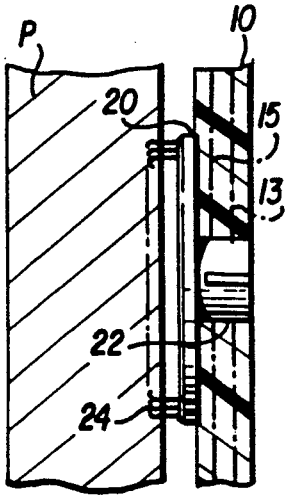
FIG. 4 is a cross-sectional view, taken along line B—B of FIG. 1 showing a Velcro® stud inserted into the pad holder in accordance with the invention and holding a pad in place.

Returning now to FIG. 1 in conjunction with FIG. 2, further features of the pad holder 10 will become apparent. On the surface of the pad holder on which the buffing pad will be mounted, and in the central portion thereof, the pad holder 10 is provided with a number of sharp projections 18 for gripping the buffing pad P when it is in position on the pad holder as shown in phantom lines in FIG. 2. For the same purpose, a number of Velcro ® studs 20 are located on the same side of pad holder 10 and are spaced about the remaining portion of the surface of the pad holder 10. Referring to FIG. 4, Velcro ® stud 20 is shown installed in a suitable aperture 22 formed in pad holder 10. Stud 20 supports a number of small hooks 24, which releasably, but firmly grip a buffing pad P when the pad is pushed into contact with hooks 24. Pad P is preferably made of a non-woven fibrous material, such as rubberized polyester fibers.

Figure 3:
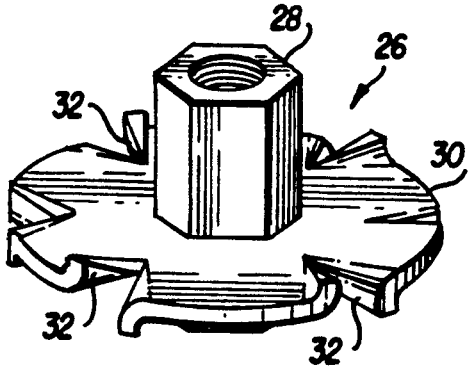
FIG. 3 is a perspective view of the hub insert which is molded in the center of the pad holder in accordance with the invention.

Molded into the center of pad holder 10 is a hub insert 26. As seen in FIG. 3, hub insert 26 has two parts, a double-chamfered, internally threaded hex nut 28, and a flange 30. Flange 30 is spot welded at six places on the flats of the hex nut, three on the top and three on the bottom. Flange 30 is slit and bent at six equally spaced locations 32. As seen in FIG. 2, hub insert 26 is thus provided with a firm support within hub 12, and is highly resistant to movement in or breakage from the hub. The purpose of hub insert 26 is two-fold. At the upper end, the threaded hub insert 26 serves to connect pad holder 10 with the drive shaft (not shown) of a floor buffing machine. At the lower end, the threaded hub insert 26 provides a connection for the pad-lock flange 33.

Figure 5:
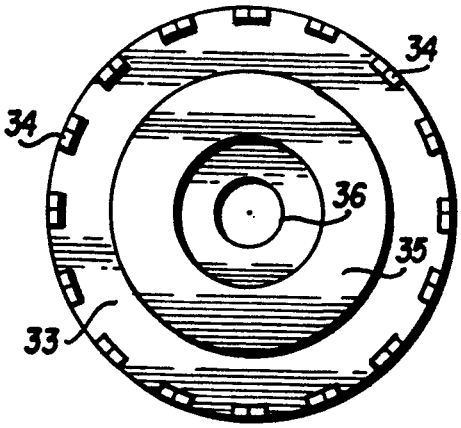
FIG. 5 is a top view of the pad-lock flange, as viewed in the direction of arrows C—C of FIG. 2, in accordance with the invention.

Pad-lock flange 33, as shown in FIG. 5 in conjunction with FIG. 2, is a disk-like element which holds the floor buffing pad firmly in place against the pad holder 10 and which allows the pad to be readily removed from the pad holder. To assist in this purpose, a plurality of triangular projections 34 are formed around the periphery of the pad-lock flange 33. An aperture 36 in the center of pad-lock flange 33 allows connection of pad-lock flange 33 to the lower thread of hub insert 26 by means of an appropriately threaded retaining bolt 38. A retainer washer 40 may be used to hold retaining bolt 38 to pad-lock flange 33 so that these two parts are conveniently held together when the bolt 38 is disengaged from the hub insert 26. A projecting annular portion 35 on the pad-lock flange 33 is used to locate or center the pad P on the flange 33. As shown in FIG. 2 a central opening in the pad P engages over the annular projecting portion 35.

In accordance with the method of making the pad holder of the present invention, use is made of the known technique of "spin casting." In the plastic molding art, one of the difficulties encountered in both hand mixed filling and low pressure injection filling of hollow cavity molds is that air becomes entrapped at the outer edges of the mold. To overcome this problem, molds are placed on a sturdy turntable similar to a potter's wheel and the mold cavity is filled while the mold is spun on the turntable. The turntable may be rotated either electrically, hydraulically or manually, and the rotational speed of the turntable may be controlled by any of these methods. The fill port of the molding compound is located on the center axis of the spinning platform. The mold must be securely attached to the platform since the mold will be in an unbalanced condition until the mold is filled. By spinning the mold when introducing the molding compound, the resin is forced to the outer periphery of the mold, displacing the air in the mold to the center, where in can escape.

The present invention employs a two-part mold to produce the desired pad holder. First, the bottom half of the mold is placed onto the spin casting machine and a mold release agent is applied to the surface of the mold. A suitable mold release is Stoner T079. Silicon mold release should not be used. Next, the metal hub insert is installed in the bottom half of the mold. The temperature of the hub insert should be about 130° F. A first fiberglass mat, without a center hole and of previously described composition is then placed in the mold. A second fiberglass mat, including a center hole, is placed on top of the first fiberglass mat. A mold release is applied to the top half of the mold and the top half is installed of the bottom half of the mold. The mold temperature should be about 110°–120° F. The mold is now set into spinning motion and brought up to a speed of approximately 1200 rpm.

In the preferred embodiment, two equal weight parts of molding compound are prepared of about 2.75 pounds each. The first part is a 60/40 blend of compound as set forth hereinabove, and is added while the mold is spinning at 1200 rpm. The compound is added through the center port and the mold is kept spinning while the compound is distributed to the outer periphery of the mold. After a short period of time, and while the mold is kept continuously spinning, the second part of the molding compound, which is a 50/50 blend, is added to the mold with the mold spinning at approximately 1000–1200 rpm. When the entire batch of molding compound of about 5.5 pounds is distributed in the mold, the spinning rate of the mold is decreased to approximately 200 rpm. The spinning is maintained at this rate for approximately 1.5 minutes, and the spinning process is stopped before the molding compound begins to harden. The molding compound is allowed to remain in the mold until hardened, generally about 20 but preferably about 30 minutes. The mold is then opened and the finished pad holder is removed from the mold.

In accordance with the inventive method, a pad holder is produced which is a unitary part having a dual durometer hardness having an increased resistance to breakage when the pad holder strikes a hard or sharp object. Since the two durometer hardness portions of the pad holder cure at the same time, the possibility of a shear failure at the boundary of two different durometer portions is greatly reduced. The molded pad holder is efficiently and economically manufactured in a one-step spin casting operation. Since there is only one layer of fiberglass reinforcement in the RI region of the pad holder, the flexibility of such region is further enhanced.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. A pad holder for use in a floor buffing machine comprising:

a unitary, one-piece member having a top surface and a bottom surface adapted to support a floor buffing pad, said member further having a dual durometer hardness in two different portions thereof, said member further comprising:

an outer annular portion formed from a first hardenable material having a first durometer hardness;

an inner annular portion formed from a second hardenable material having a second durometer hardness less than said first durometer hardness;

said outer and inner annular portions having a circumferential boundary therebetween at a given radial distance from the center of said member, the first and second hardenable materials being simultaneously hardened and intermixed with one another only along said circumferential boundary whereby said outer and inner annular portions are so intimately interconnected as to substantially prevent shear failure of said pad holder between said outer and inner annular portions.

2. The pad holder of claim 1, wherein the pad holder has a generally plate-like shape, further comprising a threaded metal hub insert molded in the center of the pad holder and aligned so that the central longitudinal axis of the hub insert is perpendicular to a plane in which the plate-like shape extends.

3. The pad holder of claim 1, wherein the pad holder has the general shape of a round plate, having a top surface and a bottom surface adapted to contact and support a floor buffing pad, the bottom surface being concave for the receipt of the pad, and the pad holder further having a thickened hub portion located at the center of the pad holder.

4. The pad holder of claim 3, further comprising a plurality of projections disposed at the center of the bottom surface of the pad holder, projecting outwardly from the bottom surface and adapted to engage and hold a floor buffing pad.

5. The pad holder of claim 1, including at least one fiberglass mat being formed in the hardenable materials of said inner and outer annular portions, said fiberglass mat extending through the circumferential boundary between said inner and outer annular portions.

6. The pad holder of claim 5, wherein said at least one fiberglass mat comprises two fiberglass mats.

7. The pad holder of claim 5, wherein said at least one fiberglass mat is circular.

8. A pad holder for use in a floor buffing machine comprising a unitary, one-piece member having a top surface and a bottom surface adapted to support a floor buffing pad, a dual durometer hardness in two different portions of said member, a first one of said portions comprising an outer annular portion formed from a first material having a first durometer hardness, a second one of said portions comprising an inner annular portion formed from a second material having a second durometer hardness less than said first durometer hardness, said outer and inner annular portions being so interconnected as to substantially prevent shear failure of said pad holder between said outer and inner annular portions, said first material comprising a resin having a formulation of 100 parts by weight of about a 60/40 blend of an unsaturated polyester and saturated polyester polyol, 27 parts by weight of a polymethylene polyphenyl isocyanate, and 2 parts by weight of benzoyl peroxide in tricresyl phosphate.

9. The pad holder of claim 8, wherein said second material is a resin having a formulation of 100 parts by weight of a 50/50 blend of an unsaturated polyester and saturated polyester polyol, 27 parts by weight of polymethylene polyphenyl isocyanate, and 2 parts by weight of benzoyl peroxide in tricresyl phosphate.

10. A pad holder for use in a floor buffing machine comprising a unitary, one-piece member having a dual durometer hardness in two different portions of said pad holder, a first one of said portions comprising an outer annular portion formed from a first material having a first durometer hardness, a second one of said portions comprising an inner annular portion formed from a second material having a second durometer hardness less than said first durometer hardness, said outer and inner annular portions being so interconnected as to substantially prevent shear failure of said pad holder between said outer and inner annular portions, said pad holder having the general shape of a round plate, said plate having a top surface and a bottom surface adapted to contact and support a floor buffing pad, the bottom surface being concave for the receipt of the pad, and the pad holder further having a thickened hub portion located at the center of the pad holder and a plurality of apertures disposed in the pad holder, each of said apertures receiving a Velcro® stud adapted to retain a floor buffing pad on the bottom surface of the pad holder.

11. The pad holder of claim 10, further comprising a threaded metal hub insert molded in the center of the pad holder and a pad-lock flange formed in the shape of a flat disk having a plurality of projections extending around the outer periphery of one side of the disk having a aperture in the center of the disk, said aperture receiving a bolt which is engagable with the threaded hub insert to removably mount said pad-lock flange on said pad holder, whereby a floor buffing pad which is placed on the concave bottom surface of the pad holder is removably locked in place between the projections of the pad holder and the projections of the pad-lock flange at the central region of the pad holder, and retained in position on the remainder of the bottom surface by the Velcro® studs.

12. A pad holder for use in a floor buffing machine comprising a unitary, one-piece member having a dual durometer hardness in two different portions of said pad holder, a first one of said portions comprising an outer annular portion formed from a first material having a first durometer hardness, a second one of said portions comprising an inner annular portion formed from a second material having a second durometer hardness less than said first durometer hardness, said outer and inner annular portions being so interconnected as to substantially prevent shear failure of said pad holder between said outer and inner annular portions, said pad holder having a general plate-like shape, a threaded metal hub insert molded in the center of the pad holder and aligned so that the central longitudinal axis of the hub insert is perpendicular to a plane in which the plate-like shape extends, and a pad-lock flange formed in the shape of a flat disk having a plurality of projections extending around the outer periphery of one side of the disk and having an aperture in the center of the disk, said aperture receiving a bolt which is engageable with the threaded hub insert, whereby the pad-lock flange is removably engaged with the pad holder to hold and lock a floor buffing pad on the pad holder.

13. A pad holder for use in a floor buffing machine comprising:

a unitary, one-piece member having a top surface and a bottom surface adapted to support a floor buffing pad, said member having a dual durometer hardness in two different annular portions thereof, said member further comprising:

an outer annular portion formed from a first moldable material having a first durometer hardness;

an inner annular portion formed from a second moldable material having a second durometer hardness less than said first durometer hardness, said inner and outer annular portions having a circumferential boundary therebetween; and at least one fiberglass mat being molded with said first and second moldable materials so as to extend through said circumferential boundary, said outer and inner annular portions being so interconnected along said circumferential boundary as to substantially prevent shear failure of said pad holder between said outer and inner annular portions.

* * * * *